US009711869B1

(12) United States Patent
Kwon et al.

(10) Patent No.: US 9,711,869 B1
(45) Date of Patent: Jul. 18, 2017

(54) HEXAFERRITE SLANT AND SLOT MIMO ANTENNA ELEMENT

(71) Applicant: Wichita State University, Wichita, KS (US)

(72) Inventors: Hyuck M. Kwon, Wichita, KS (US); Chandana K. K. Jayasooriya, Wichita, KS (US); Yang-Ki Hong, Tuscaloosa, AL (US); Ryan Syslo, Dothan, AL (US)

(73) Assignees: Wichita State University, Wichita, KS (US); The Universisty of Alabama, Tuscaloosa, AL (US)

( * ) Notice: Subject to any disclaimer, the term of this patent is extended or adjusted under 35 U.S.C. 154(b) by 397 days.

(21) Appl. No.: 13/789,023

(22) Filed: Mar. 7, 2013

(51) Int. Cl.
*H01Q 21/00* (2006.01)
*H01P 11/00* (2006.01)

(52) U.S. Cl.
CPC ..... *H01Q 21/0006* (2013.01); *H01P 11/001* (2013.01)

(58) Field of Classification Search
CPC H01Q 1/38; H01Q 1/243; H01Q 1/48; H01Q 1/52; H01Q 1/521
USPC ..... 343/893, 702, 700 MS, 846, 848
See application file for complete search history.

(56) References Cited

U.S. PATENT DOCUMENTS

| | | | | |
|---|---|---|---|---|
| 6,549,170 | B1 * | 4/2003 | Kuo et al. | 343/702 |
| 7,245,259 | B2 * | 7/2007 | Puckey et al. | 343/700 MS |
| 7,289,068 | B2 * | 10/2007 | Fujio et al. | 343/700 MS |
| 8,441,408 | B2 * | 5/2013 | Kim et al. | 343/848 |
| 2005/0110683 | A1 * | 5/2005 | Song et al. | 343/700 MS |
| 2010/0238072 | A1 * | 9/2010 | Ayatollahi et al. | 343/700 MS |
| 2012/0032836 | A1 * | 2/2012 | Shamim | G01S 7/03 342/175 |
| 2014/0159973 | A1 * | 6/2014 | Hong et al. | 343/787 |

* cited by examiner

*Primary Examiner* — Huedung Mancuso
(74) *Attorney, Agent, or Firm* — Norton Rose Fulbright US LLP

(57) ABSTRACT

A MIMO antenna for mobile devices has a system board, and two or more microstrip lines extending along a top surface of the system board. The MIMO antenna additionally includes a ground plane extending along a bottom surface of the system board, wherein the ground plane has a Y-shaped slot. The MIMO antenna further includes one or more pairs of miniature antenna elements attached to the top surface of system board in contact with the at least two microstrip lines, wherein the antenna elements are slanted at ±45° with respect to a center Z of an X Y coordinate system, and center of a radiation sphere, located proximate the Y-shaped slot.

36 Claims, 8 Drawing Sheets

HEXAFERRITE SLANT AND SLOT MIMO ANTENNA ELEMENT

TECHNICAL FIELD

This disclosure is generally directed to MIMO antennas. This disclosure is specifically directed to a hexaferrite slant and slot MIMO antenna element implemented in wireless communication systems.

BACKGROUND

There is an increasing demand for multiple-input multiple-output (MIMO) communication technology in wireless communication systems due to the need for higher channel capacity. In a MIMO system, low mutual coupling and high isolation between antennas are important for obtaining antenna diversity and high radiation efficiency. As such, achieving low mutual coupling and high isolation between neighboring antenna elements is a concern in MIMO antenna design, and many designs have been developed to improve isolation between neighboring antenna elements.

However, a competing concern in MIMO antenna design is the limited mobile device space, which requires a smaller antenna size. Reducing the size of MIMO antennas is often at odds with the goal of achieving low mutual coupling and high isolation between neighboring antenna elements. In view of the above, a need exists for an antenna design that successfully reduces the size of a MIMO antenna while retaining low mutual coupling and high isolation between neighboring antenna elements.

BRIEF SUMMARY

In some aspects, a MIMO antenna for mobile devices has a system board, and two or more microstrip lines extending along a top surface of the system board. The MIMO antenna additionally includes a ground plane extending along a bottom surface of the system board, wherein the ground plane has a Y-shaped slot. The MIMO antenna further includes one or more pairs of miniature antenna elements attached to the top surface of system board in contact with the at least two microstrip lines, wherein the antenna elements are slanted at ±45° with respect to a center Z of an X Y coordinate system, and center of a radiation sphere, located proximate the Y-shaped slot.

In other aspects, a method of performing wireless communications includes utilizing a MIMO antenna to transmit and receive wireless signals. The MIMO antenna includes a system board, and two or more microstrip lines extending along a top surface of the system board. The MIMO antenna additionally includes a ground plane extending along a bottom surface of the system board, wherein the ground plane has a Y-shaped slot. The MIMO antenna further includes one or more pairs of miniature antenna elements attached to the top surface of system board in contact with the at least two microstrip lines, wherein the antenna elements are slanted at ±45° with respect to a center Z of an X Y coordinate system, and center of a radiation sphere, located proximate the Y-shaped slot.

In further aspects, a method of manufacturing a hexaferrite slant and slot MIMO antenna includes providing one or more pairs of antenna elements having hexaferrite antenna substrates. The method additionally includes positioning the pair of antenna elements to be slanted at ±45° with respect to a center Z of an X Y coordinate system, and center of a radiation sphere, that is located proximate a Y-shaped slot of a ground plane of a system board. The method further includes attaching the antenna elements to a top surface of the system board.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying FIGURES, in which.

DETAILED DESCRIPTION

Techniques and methods are disclosed for the design, manufacture, and use of a hexaferrite slant and slot MIMO antenna in wireless communication systems that exhibits superior characteristics. As will be explained in greater detail below, according to one embodiment, a standard FR-4 substrate may be used as a double copper clad system board with a hexaferrite substrate for miniature antenna elements. Relative permeability ($\mu_r$) and relative permittivity ($\epsilon_r$) of the hexaferrite substrate enables reduction of the antenna element size by a factor of $1/\sqrt{\mu_r\epsilon_r}$. For example, a hexaferrite substrate having a volume of 6×10×1.5 $mm^3$ exhibits a relative permeability $\mu_r$ of 1.66 (tan $\delta_\mu$=0.112) and a relative permittivity $\epsilon_r$ of 6.5 (tan $\delta_\epsilon$=0.014).

According to an embodiment, reducing surface area and/or volume of the antenna elements increases the physical separation between those elements. As a result, the transmission/reception isolation between the antenna elements increases. Removing the slot in the ground plane improves isolation and frequency matching, and is combined with slanting of the antenna elements to provide pattern diversity. This combination of features leads to improvement in isolation and capacity, as can be observed by measured performance of a fabricated hexaferrite slant and slot MIMO antenna according to concepts described herein, yielding a correlation coefficient less than 0.00085 between 2.4-2.5 GHz.

The following description provides details of both simulated (see FIG. 1 and FIG. 2) and fabricated (see FIG. 4 and FIG. 5) hexaferrite slant and slot MIMO antennas according to inventive concepts described herein. The following description also provides details of a method of manufacturing (see FIG. 3) a hexaferrite slant and slot MIMO antenna according to inventive concepts described herein.

As will be further demonstrated below with respect to FIGS. 6-11, the fabricated hexaferrite slant and slot MIMO antenna exhibits many characteristics that render it useful for wireless communications. Embodiments may be operable in, e.g., the Bluetooth and WLAN IEEE 802.11b/g (2400-2484 MHz) bands. For example, the fabricated MIMO antenna has a size on the order of (60×90×1.5 $mm^3$) suitable for embedding in a smartphone, and it may also be used in larger devices, such as wireless routers. Additionally, according to one embodiment, measured return loss and isolation were measured at 33.9/26.6 dB (for antenna 1/antenna 2) and 18.6 dB at 2.45 GHz, respectively. Also, bandwidth was observed to be 454/502 MHz at VSWR<3. Further, radiation efficiency of the antennas was measured to be 82% at 2.45 GHz. Further still, the antenna elements were observed to exhibit orthogonal 2D patterns (two lobe pattern set and omnidirectional flower pattern set) that make the MIMO antenna a candidate for 2.45 GHz mobile device applications.

Figure 1:
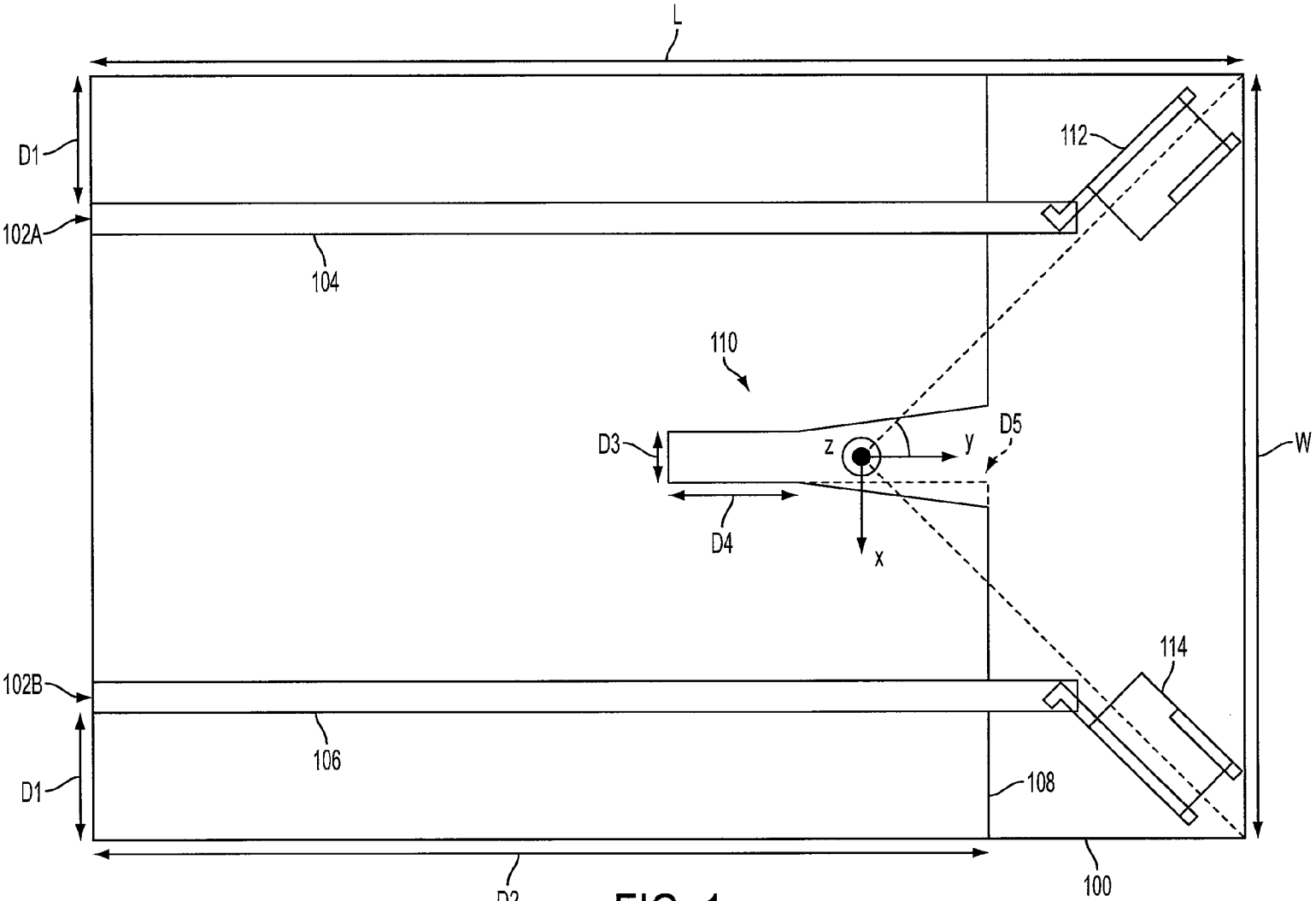
FIG. 1 is a block diagram providing a plan view of a hexaferrite slant and slot MIMO antenna in accordance with the present disclosure.

FIG. 1 illustrates geometry of a simulated hexaferrite slant and slot MIMO antenna. According to the illustrated embodiment, a system board 100 is made of double-sided copper clad laminate, such as fiberglass reinforced epoxy laminates that are Flame Retardant (FM4). The system board 100 has a width W of 60 mm and a length L of 90 mm, yielding relative permittivity and loss tangent values of the system board of 4.4 and 0.02, respectively. Spaced apart lumped ports 102A and 102B are provided at one end of the system board 100, and the ports 102A and 102B are respectively located a dimension D1 of 10 mm from opposite sides of the system board 100. Two microstrip lines 104 and 106, measuring 2.4×77 $mm^2$, longitudinally extend in parallel from the lumped ports 102 along a top surface of the system board 100. A ground plane 108 having a width of 60 mm longitudinally extends from the lumped ports 102 a length D2 of 70 mm along a bottom surface of the system board. The ground plane 108 has a Y-shaped slot 110 having a narrow end that is oriented toward the lumped ports 102, and that has a width D3 of 4 mm. Sides of the Y-shaped slot 110 extend in parallel from the narrow end a length D4 equal to 10 mm before beginning to expand apart from one another to form an expansion region. In the expansion region, the sides of the Y-shaped slot 110 further extend away from the lumped ports 102 in non-parallel fashion for an additional length D5 equal to 15 mm, yielding an overall length to the Y-shaped slot of 25 mm. At a wide end of the Y-shaped slot 110 that is opposite the narrow end, the width of the slot is equal to 8 mm.

A pair of miniature antenna elements 112 and 114 are half-cycle, microstrip meander structures having a ferrite substrate below each meander structure. These miniature antenna elements 112 and 114 are attached to the top surface of system board 100 in contact with the microstrip lines 104 and 106. Additionally, these antenna elements are located at an end of the system board 100 that is opposite the lumped ports 102, and more than 70 mm from the lumped ports 102. This location of the miniature antenna elements 112 and 114 ensures that they are not located directly above any portion of the ground plane 108. Also, the miniature antenna elements 112 and 114 are spaced apart from one another approximately 30 mm or more. Further, the antenna elements 112 and 114 are slanted at ±45° with respect to a center Z of an X Y coordinate system, and center of a radiation sphere, located proximate an origin of an expansion region of the Y-shaped slot 110 of the ground plane 108.

Figure 2:
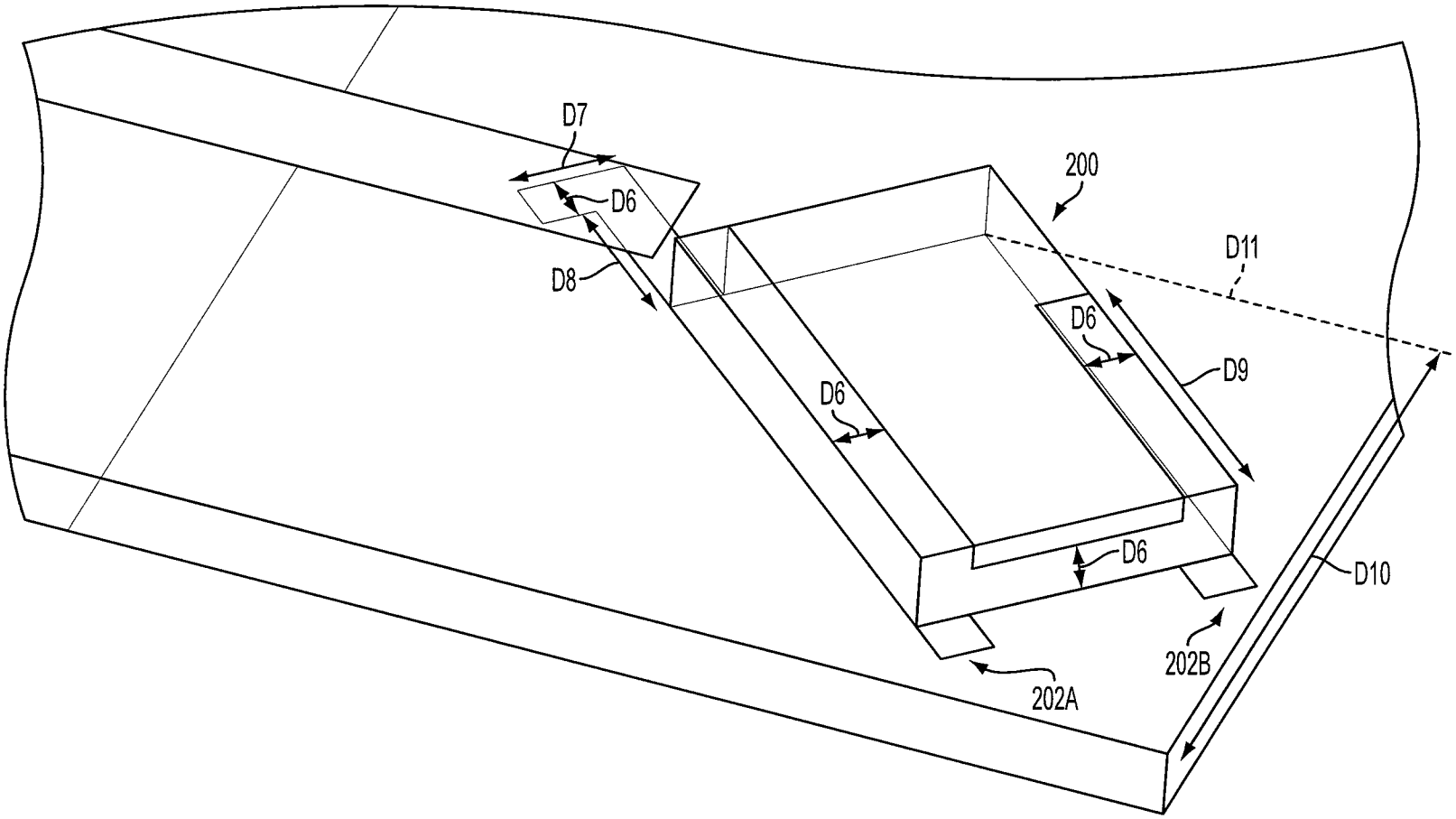
FIG. 2 is a block diagram providing an isometric view of an antenna element of the hexaferrite slant and slot MIMO antenna of FIG. 1.

Turning to FIG. 2, a miniature antenna element of the simulated design of a hexaferrite slant and slot MIMO antenna is shown in greater detail. In the simulated design, the hexaferrite substrate 200 has dimensions of 6×10×1.5 $mm^3$. Consequently, the permeability and permittivity of the hexaferrite substrate 200, obtained by polynomial fitting using measured vector network analyzer (VNA) scattering parameters of sintered $Co_2Z$-glass composite ring, are $\mu_r$ of 1.66 and $\epsilon_r$ of 6.5 with magnetic loss tangent of tan $\delta_\mu$ of 0.112 and tan $\delta_\epsilon$ of 0.014, respectively. Copper (Cu) tape may be attached to the hexaferrite substrate 200 to provide the half-cycle, microstrip meander structure, as well as electrical connection to the microstrip, and 1×1 $mm^2$ solder pads 202A and 202B. In the simulated design, the Cu tape has a width D6 equal to 1 mm, electrical connection dimensions D7 and D8 equal to 2 mm and 3 mm, respectively, and a meander structure length D9 equal to 6 mm. The positioning of the antenna element is such that a corner of the substrate 200 most proximate a neighbor antenna element is located a dimension D10 equal to 13 mm from a nearest side edge of the system board, and a dimension D11 equal to 8 mm from a nearest end edge of the system board.

Figure 3:
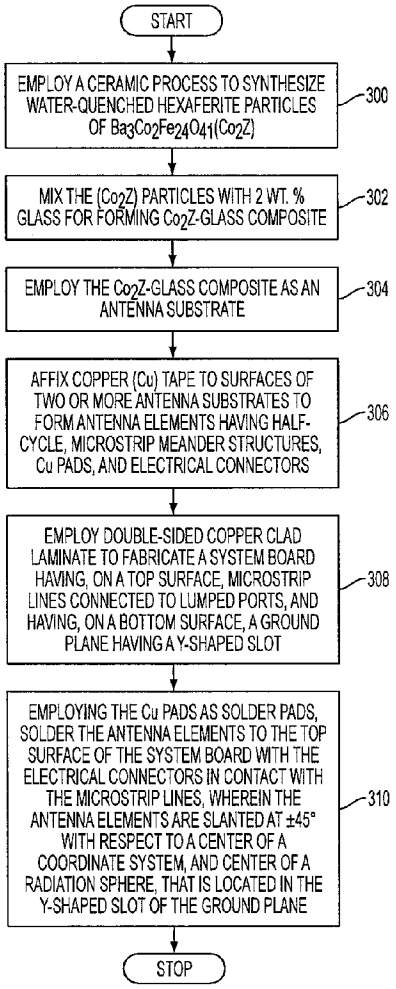
FIG. 3 is a flow diagram illustrating a method of manufacturing a hexaferrite slant and slot MIMO antenna in accordance with the present disclosure.

Turning to FIG. 3, a method of manufacturing a fabricated hexaferrite slant and slot MIMO antenna may include employing a ceramic process, at step 300, to synthesize water-quenched hexaferrite particles of $Ba_3Co_2Fe_{24}O_{41}$ ($Co_2Z$). At step 302, the ($Co_2Z$) particles may be mixed with 2 wt. % glass for forming $Co_2Z$-glass composite. At step 304, the $Co_2Z$-glass composite may be utilized as an antenna substrate. Step 302 may include forming two or more antenna substrates of the $Co_2Z$-glass composite. One skilled in the art will readily recognize that size of the antenna substrates may vary, and that dimensions of 6×10×1.5 $mm^3$ and 8×6×1.5 $mm^3$ are merely examples of dimensions for the antenna substrate. At 306, Cu tape may be affixed to surfaces of the two or more antenna substrates to form antenna elements having Cu pads, electrical connections, and half-cycle, microstrip meander structures atop the antenna substrates. Alternatively, or in addition to, the Cu tape, it is envisioned that any other material or combination of materials suitable for forming the meander structures may be employed, as will be readily apparent to one skilled in the art. At step 308, double-sided copper clad laminate may be employed to fabricate a system board having, on a top surface, microstrip lines connected to lumped ports, and having, on a bottom surface, a ground plane having a Y-shaped slot. Finally, at step 310, the Cu pads may be employed as solder pads, and the antenna elements may be soldered to the top surface of the system board with the electrical connectors in contact with the microstrip lines, at locations opposite the lumped ports. Step 310 may also include positioning the antenna elements to be slanted at ±45° with respect to a center Z of an X Y coordinate system, and center of a radiation sphere, that is located proximate the Y-shaped slot of the ground plane. It is envisioned that any other suitable method of attaching the antenna elements to the system board may be utilized as will be readily apparent to one skilled in the art.

Figure 5:
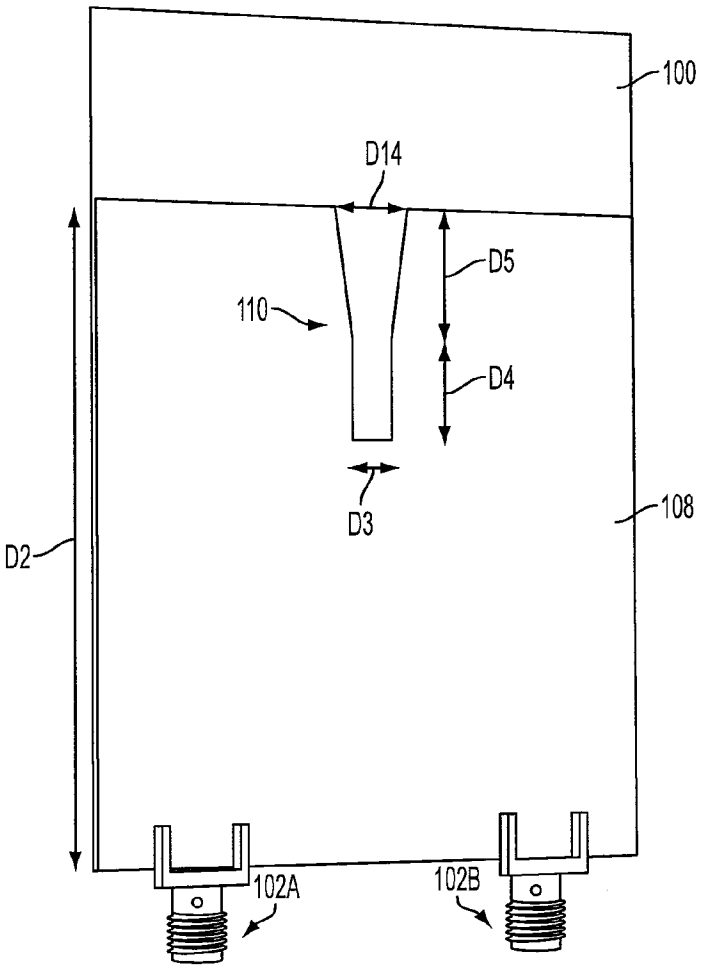
FIG. 5 is a bottom view of the fabricated hexaferrite slant and slot MIMO antenna of FIG. 4.
Figure 4:
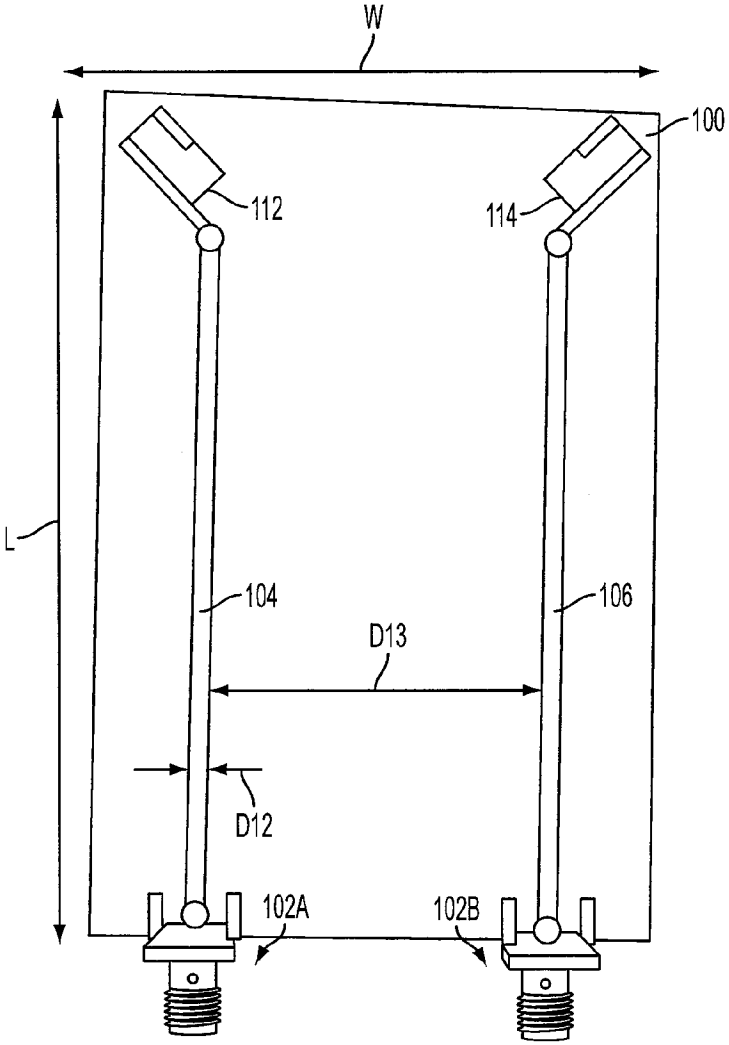
FIG. 4 is a top view of a fabricated hexaferrite slant and slot MIMO antenna in accordance with the present disclosure.

Turning to FIG. 4 and FIG. 5 and referring generally thereto, a fabricated hexaferrite slant and slot MIMO antenna manufactured by the method of FIG. 3 has features similar to those of the simulated hexaferrite slant and slot MIMO antenna of FIG. 1. For example, the fabricated hexaferrite slant and slot MIMO antenna has the system board 100 made of double-sided copper clad laminate, and having the width W of 60 mm and the length L of 90 mm. Additionally, spaced apart lumped ports 102 are provided with SubMiniature version A (SMA) connectors at one end of the system board 100. Also, two microstrip lines 104 and 106, longitudinally extend in parallel a length of 77 mm from the lumped ports 102 along a top surface of the system board 100. These microstrip lines 104 and 106 each measure a dimension D12 equal to 2.4 mm wide, and are spaced apart from one another a dimension D13 equal to 35.2 mm. Further, a ground plane 108 longitudinally extends from the lumped ports 102 a dimension D2 of 70 mm along a bottom surface of the system board. The ground plane has a Y-shaped slot 110 that is a dimension D3 of 4 mm wide at a narrow end of the slot that is oriented toward the lumped ports 102. Yet further, sides of the Y-shaped slot 110 extend in parallel from the narrow end a length D4 equal to 10 mm before beginning to expand apart from one another to form an expansion region. In the expansion region, the sides of the Y-shaped slot 110 further extend away from the lumped ports 102 in non-parallel fashion for an additional length D5 equal to 15 mm, yielding an overall length to the Y-shaped slot of 25 mm. At a wide end of the Y-shaped slot 110, the width D14 of the slot is equal to 8 mm.

The fabricated hexaferrite slant and slot MIMO antenna also exhibits the pair of miniature antenna elements 112 and 114 that are attached to the top surface of the system board 100 and in contact with the microstrip lines 104 and 106. These antenna elements 112 and 114 are located at an end of the system board 100 opposite the lumped ports 102. The miniature antenna elements 112 and 114 are spatially separated, half-cycle, microstrip meander structures having a ferrite substrate below each meander structure. Also, the antenna elements 112 and 114 are slanted at ±45° with respect to a center Z of an X Y coordinate system, and center of a radiation sphere, located proximate an origin of the expansion region of the Y-shaped slot 110 of the ground plane 108. Further, the dimensions of the hexaferrite substrates and Cu tape may be identical those discussed above with respect to FIG. 2. Alternatively, specific dimensions of the antenna elements 112 and 114 may differ from those exhibited in FIG. 2 in having a length of 8 mm and a width of 6 mm. As a result of these differences, the fabricated hexaferrite substrate may exhibits a relative permittivity of 6.6 and a relative permeability of 1.8, with corresponding loss tangents of 0.014 and 0.112, respectively. Additionally, the meander structure formed by the Cu tape may also differ from that of FIG. 2 in having a length equal to 7 mm along one side of the antenna elements. However, it should be understood that, in the measured antenna performance detailed below with respect to FIGS. 6-11, antenna elements in the fabricated antenna are utilized that have dimensions substantially equal to those of the simulated antenna element of FIG. 2

Turning now to FIGS. 6-11, both simulated and measured performance characteristics of the simulated and fabricated designs are described in detail. For the simulated performance, the Ansoft High Frequency Structure Simulator (HFSS) ver. 11 was used to simulate the antenna performance. For the measured performance, VNA port 1 and 2 of a VNA (Agilent N5230A) were connected to antenna 2 and 1, respectively, with the cables sandwiched between absorbers to eliminate surface currents on the cables.

Figure 6:
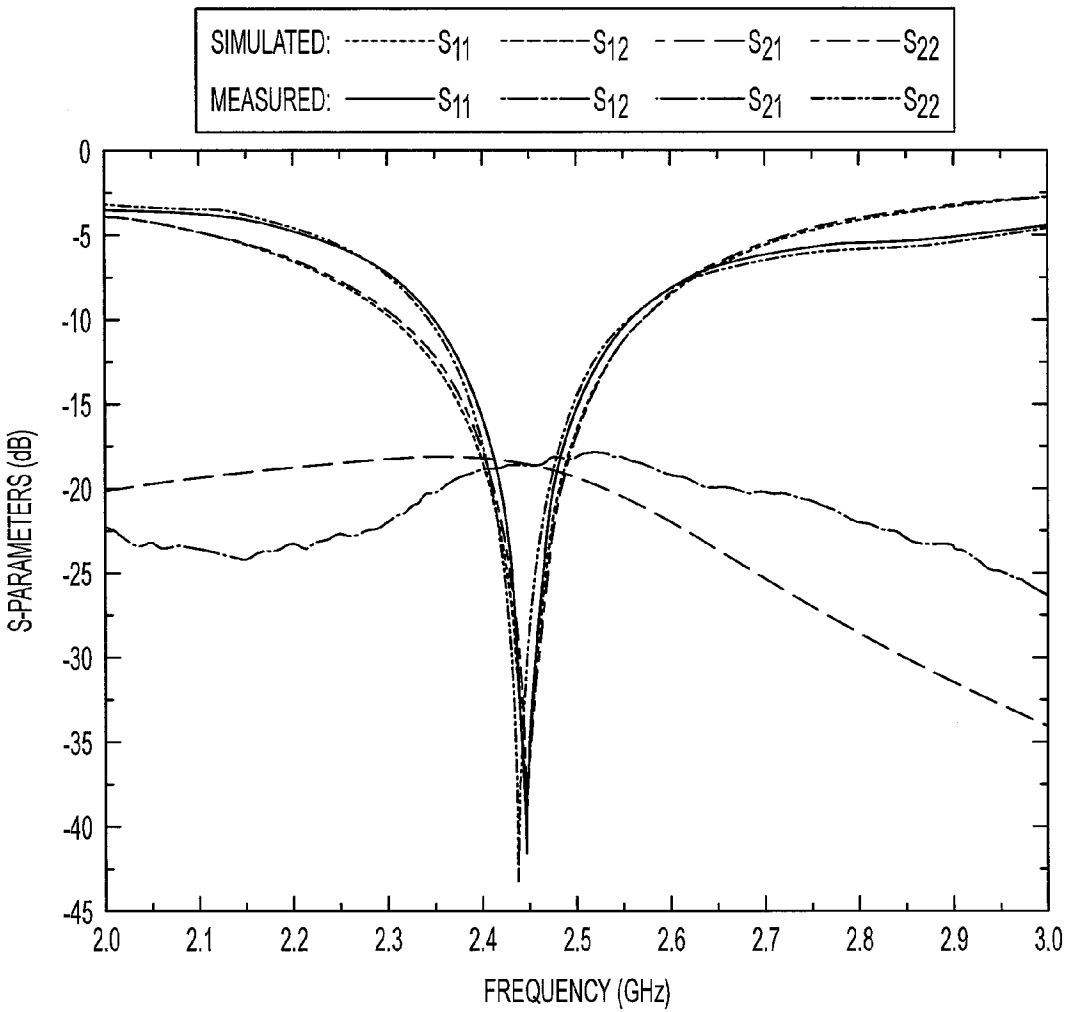
FIG. 6 is a graphical representation illustrating simulated and measured S-parameter spectra of the $Co_2Z$-glass composite MIMO antenna (1: antenna 1; 2: antenna 2) in accordance with the present disclosure.

FIG. 6 shows the simulated and measured scattering parameters of the hexaferrite MIMO antenna. Measured return loss at 2.45 GHz was found to be −33.9 and −26.6 dB for antenna 1 and 2, respectively. The measured isolation was −18.6 dB at 2.45 GHz. The bandwidth was 454 MHz (2.262-2.716 GHz) and 502 MHz (2.262-2.764 GHz) for antenna 1 and 2, respectively, at VSWR<3. The antenna dimension and performance results are summarized in Table 1.

TABLE 1

| SUBSTRATE MATERIAL | Simulated | Measured |
|---|---|---|
| Substrate size ($mm^3$) | 90 (6 × 10 × 1.5) | 90 (6 × 10 × 1.5) |
| Slot angle (degree) | +45°/−45° | +45°/−45° |
| Center frequency $f_c$ (GHz) | 2.45 | 2.45 |
| Return loss $S_{11}/S_{22}$ (dB) | −34.3/−36.3 | −33.9/−26.6 |
| Bandwidth (MHz) at VSWR < 3 | Antenna 1: 490<br>Antenna 2: 500 | Antenna 1: 454<br>Antenna 2: 502 |
| Isolation (dB) | −18.6 | −18.6 |
| Radiation efficiency, η (%) | 78 | 82 |

Figure 7:
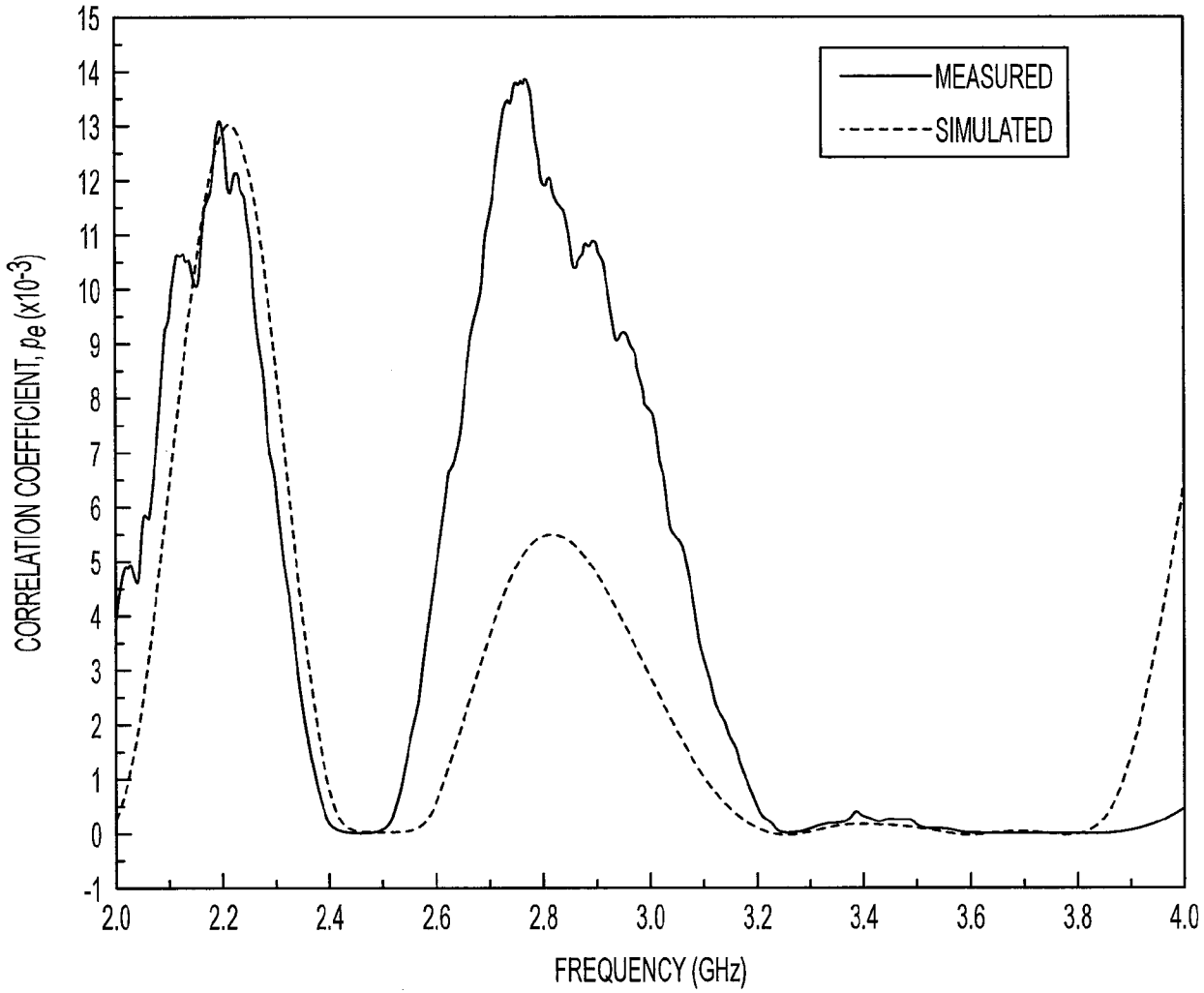
FIG. 7 is a graphical representation illustrating a correlation coefficient calculated from simulated and measured complex S-parameter of the $Co_2Z$-glass composite MIMO antenna in accordance with the present disclosure.

Referring to FIG. 7, the envelope correlation coefficient ($\rho_e$) was calculated to verify low mutual coupling between the two antenna elements. The correlation coefficient for both simulation and VNA measurement, in FIG. 7, was calculated by inputting the complex S-parameters into the following equation:

$$\rho_e = \frac{|S_{11}^* S_{12} + S_{21}^* S_{22}|^2}{(1-(|S_{11}|^2+|S_{21}|^2))(1-(|S_{22}|^2+|S_{12}|^2))} \quad (1)$$

where (*) denotes the complex conjugate. The correlation coefficients for the hexaferrite MIMO antenna between 2.4 and 2.5 GHz are less than peak correlation coefficient from measurement of 0.00085 at 2.4 GHz. The correlation coefficient from measurement at 2.45 GHz is $1.46\times10^{-5}$. Therefore, it can be appreciated that the antenna elements are essentially decoupled as the correlation coefficient is approximately zero. The correlation coefficients from simulated and measured performance are in substantial agreement with each other, but there are some observable differences that are attributed to fabrication deviation from design.

The radiation efficiency (η) of the hexaferrite slant and slot MIMO antenna was simulated and measured at 2.45 GHz. The radiation efficiency computed by HFSS for both antennas (1 and 2) was approximately 78%. The 3D gain pattern (far field) of the hexaferrite MIMO antenna, with one SMA jack connected and other left open, was measured in a custom anechoic chamber at The Howland Company. There was no noticeable difference in gain pattern if the open SMA jack (Emerson 142-0701-851) was terminated by 50Ω, because the antennas are decoupled ($\rho_e \approx 0$) as previously mentioned. The η was calculated from the 3D gain pattern, which was measured with the turntable rotating from 0 to 345° in 15° increments for each position of the dual polarized horn from 15 to 165° in 15° increments.

Regarding the radiation efficiency calculation, the radiation efficiency is defined as:

$$\eta = \frac{TRP}{P_t} \tag{2}$$

where TRP is the total radiated power (W) and $P_t$ is the power (W) at the antenna input port. TRP can be expressed as:

$$TRP = \frac{P_t}{4\pi}\int_{\theta=0}^{\pi}\int_{\phi=0}^{2\pi} G_t(\theta, \phi)\sin(\theta)\, d\theta\, d\phi \tag{3}$$

where $G_t$ is the angle-dependent total antenna gain (dimensionless ratio). Combining (2) and (3), the resulting integral equation can be approximated in discrete form as:

$$\eta \approx \frac{\pi}{2 \cdot M \cdot N}\sum_{n=0}^{N-1}\sum_{m=0}^{M-1} G_t(\theta_n, \phi_m)\sin(\theta_n) \tag{4}$$

where the gain from the dual polarizations of the horn can be expressed as $G_r(\theta_n, \phi_m)=G_\theta(\theta_n, \phi_m)+G_\phi(\theta_n, \theta_m)$ in decibel (dB). The angle-dependent gains obtained from measurement were used to calculate the radiation efficiency using (4), which for both antennas was approximately 82%.

Figure 9:
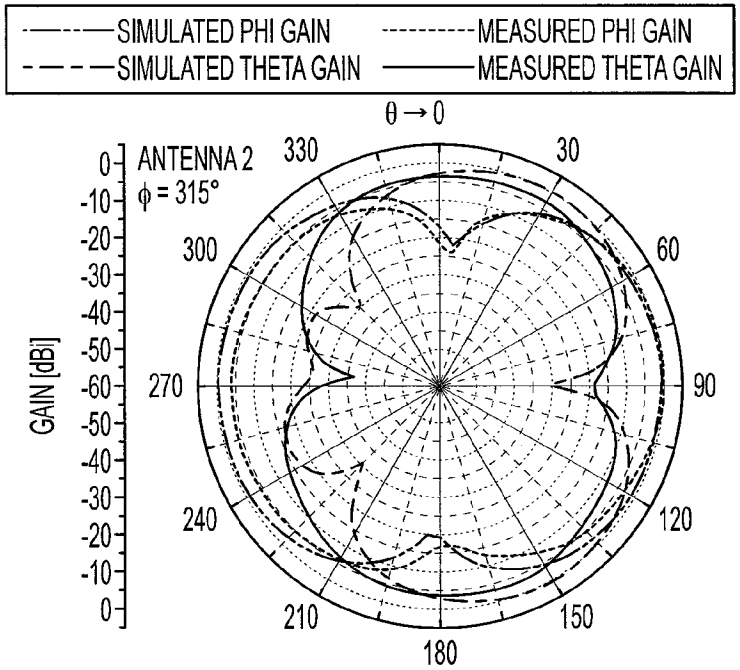
FIG. 9 is a graphical representation illustrating simulated and measured 2D gain patterns of a $Co_2Z$-glass composite MIMO antenna at 2.45 GHz for antenna 2 at $\phi$=315°.
Figure 8:
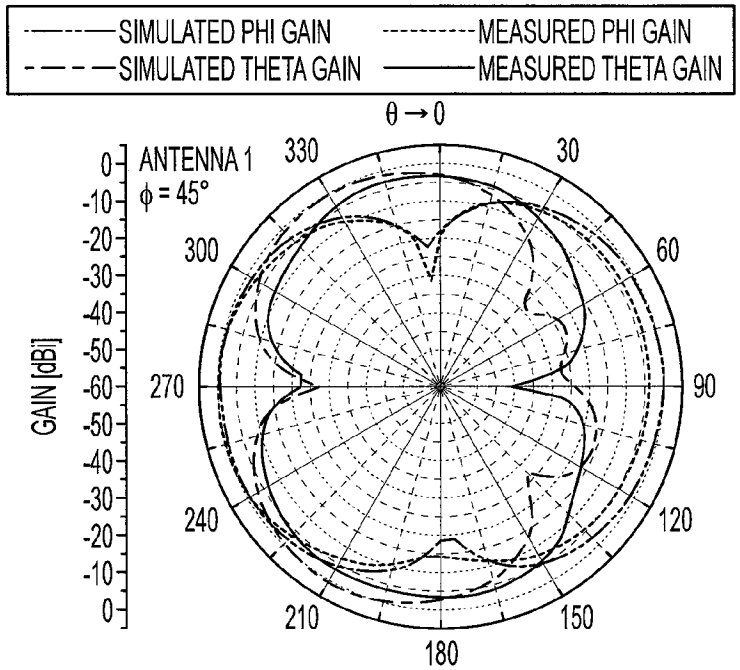
FIG. 8 is a graphical representation illustrating simulated and measured 2D gain patterns of a $Co_2Z$-glass composite MIMO antenna at 2.45 GHz for antenna 1 at =45°.
Figure 11:
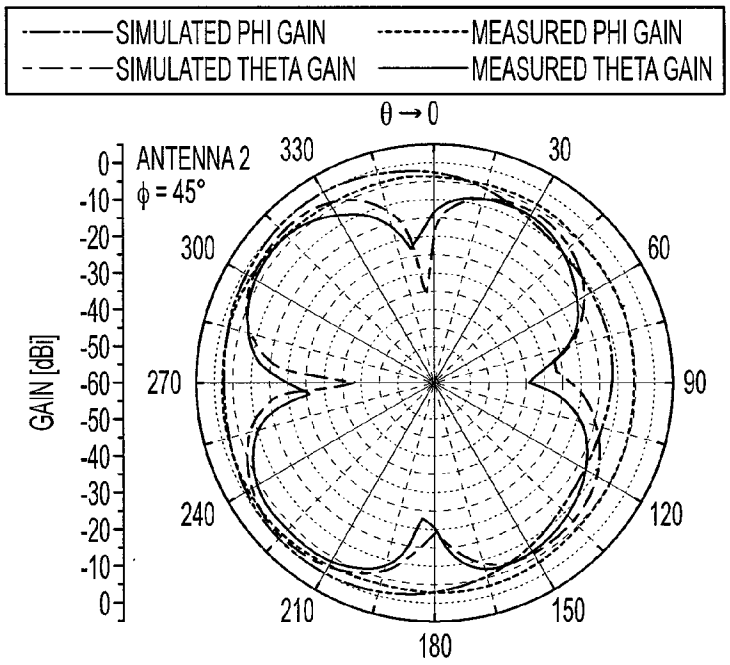
FIG. 11 is a graphical representation illustrating simulated and measured 2D gain patterns of a $Co_2Z$-glass composite MIMO antenna at 2.45 GHz for antenna 2 at 4=45°.
Figure 10:
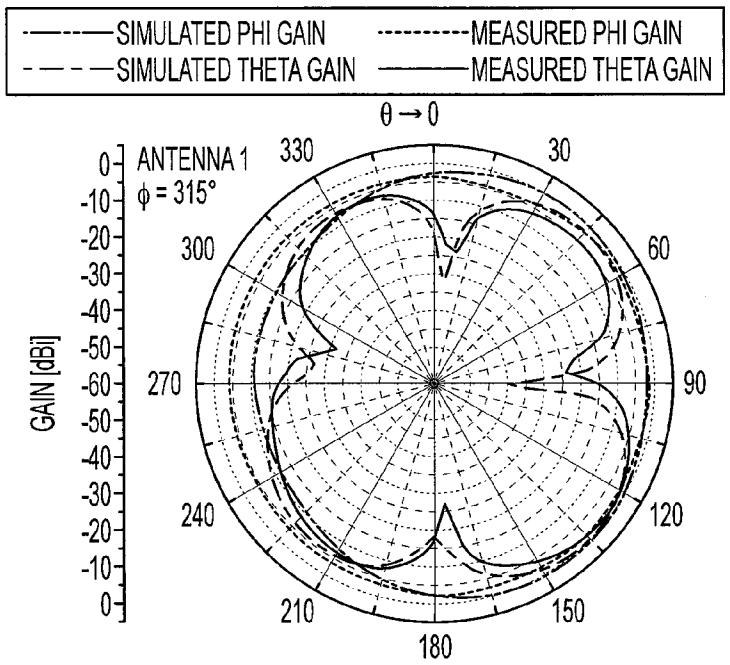
FIG. 10 is a graphical representation illustrating simulated and measured 2D gain patterns of a $Co_2Z$-glass composite MIMO antenna at 2.45 GHz for antenna 1 at $\phi$=315°.

Turning now to FIGS. 8-11, simulated and measured 2D gain patterns (far field) for antenna 1 and 2 were obtained from an antenna measurement system (Raymond EMC QuietBox AVS 700) having a turntable rotating from 0 to 355° in 5° increments in front of a dual polarized horn. ϕ is the angle from the x-axis toward the y-axis, and θ is the angle from the z-axis. FIGS. 8 and 9 show a set of orthogonal two lobe patterns in ϕ (=45°−(−45°)=90° for antenna 1 and antenna 2, respectively. FIGS. 10 and 11 show a set of orthogonal omnidirectional-flower patterns in ϕ for antennas 1 and 2, respectively. Potentially, these 2D patterns may be utilized for mobile or base station applications when a horizontal and/or vertically polarized antenna (e.g., dual polarized horn) is used. It can be readily appreciated that the simulated and measured gain patterns are substantially in agreement with one another.

The functional blocks and modules in FIG. 3 may comprise processors, electronics devices, hardware devices, electronics components, logical circuits, memories, software codes, firmware codes, etc., or any combination thereof.

Those of skill would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure.

The various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. A storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk and blu-ray disc where disks usually reproduce data magnetically, while discs reproduce data optically with lasers. Combinations of the above should also be included within the scope of computer-readable media.

Although the present invention and its advantages have been described in detail, it should be understood that various changes, substitutions and alterations may be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A hexaferrite slant and slot MIMO antenna for mobile devices, the antenna comprising:

a system board;

a ground plane extending along a bottom surface of the system board, wherein the ground plane has a Y-shaped slot;

a first lumped port and a second lumped port at a first side of the system board;

at least two microstrip lines, where a first microstrip line extends from the first lumped port and a second microstrip line extends from the second lumped port in parallel fashion along a top surface of the system board to a second side of the system board and past a narrow end of the Y-shaped slot; and at least one pair of miniature antenna elements attached to the top surface of the system board in contact with the at least two microstrip lines, wherein the miniature antenna elements are slanted at ±45° with respect to a center Z of an X Y coordinate system, and a center of a radiation sphere, located proximate to the Y-shaped slot;

where the Y-shaped slot has a narrow end oriented away from the at least one pair of miniature antenna elements, a wide end oriented toward the at least one pair of miniature antenna elements, and an expansion region in which sides of the Y-shaped slot extend in diverging fashion toward the at least one pair of miniature antenna elements.

2. The MIMO antenna of claim 1, wherein the system board is predominately made of double-sided copper clad laminate.

3. The MIMO antenna of claim 1, wherein the system board has a width 60 mm and a length L of 90 mm, yielding permittivity and loss tangent values of the system board of 4.4 and 0.02, respectively.

4. The MIMO antenna of claim 1, where the first lumped port and the second lumped port at the first side of the system board are opposite a second end of the system board that is proximate to the pair of antenna elements.

5. The MIMO antenna of claim 4, wherein the ground plane longitudinally extends a length of about 70 mm from the first and second lumped ports along the bottom surface of the system board.

6. The MIMO antenna of claim 1, wherein the least two microstrip lines measure 2.4×77 $mm^2$.

7. The MIMO antenna of claim 1, wherein the ground plane has a width of 60 mm.

8. The MIMO antenna of claim 1, wherein the center Z of the X Y coordinate system, and the center of the radiation sphere, are located proximate an origin of the expansion region.

9. The MIMO antenna of claim 1, wherein the narrow end has a width of 4 mm and the wide end has a width of 8 mm.

10. The MIMO antenna of claim 1, wherein sides of the Y-shaped slot extend in parallel from the narrow end a length equal to 10 mm before beginning to expand apart from one another to form the expansion region.

11. The MIMO antenna of claim 1, wherein the Y-shaped slot has an overall length of 25 mm.

12. The MIMO antenna of claim 1, wherein the miniature antenna elements of the at least one pair of miniature antenna elements are spaced apart from one another approximately 30 mm.

13. The MIMO antenna of claim 1, wherein the pair of miniature antenna elements includes half-cycle, microstrip meander structures having a hexaferrite substrate below each meander structure.

14. The MIMO antenna of claim 13, wherein the hexaferrite substrate has dimensions substantially equal to 6×10×1.5 $mm^3$.

15. The MIMO antenna of claim 13, wherein the hexaferrite substrate exhibits a relative permeability $\mu_r$ substantially equal to 1.66 (tan $\delta_\mu$=0.112) and a relative permittivity $\epsilon_r$ substantially equal to 6.5 (tan $\delta_\epsilon$=0.014).

16. The MIMO antenna of claim 13, wherein copper (Cu) tape is attached to the hexaferrite substrate to provide the half-cycle, microstrip meander structure, as well as an electrical connection to the microstrip lines, and 1×1 $mm^2$ solder pads.

17. The MIMO antenna of claim 1, wherein the MIMO antenna exhibits a radiation efficiency of at least 82% at 2.45 GHz.

18. The MIMO antenna of claim 1, wherein the at least one pair of miniature antenna elements exhibit orthogonal 2D patterns, including a two lobe pattern set and an omnidirectional flower pattern set.

19. A method of performing wireless communications, comprising:

utilizing a MIMO antenna to transmit and receive wireless signals, wherein the MIMO antenna comprises:

a system board;

a ground plane extending along a bottom surface of the system board, wherein the ground plane has a Y-shaped slot;

a first lumped port and a second lumped port at a first side of the system board;

at least two microstrip lines, where a first microstrip line extends from the first lumped port and a second microstrip line extends from the second lumped port in parallel fashion along a top surface of the system board to a second side of the system board and past a narrow end of the Y-shaped slot; and at least one pair of miniature antenna elements attached to the top surface of the system board in contact with the at least two microstrip lines, wherein the miniature antenna elements are slanted at ±45° with respect to a center Z of an X Y coordinate system, and a center of a radiation sphere, located proximate to the Y-shaped slot;

where the Y-shaped slot has a narrow end oriented away from the at least one pair of miniature antenna elements, a wide end oriented toward the at least one pair of miniature antenna elements, and an expansion region in which sides of the Y-shaped slot extend in diverging fashion toward the at least one pair of miniature antenna elements.

20. The method of claim 19, wherein utilizing a MIMO antenna includes utilizing a MIMO antenna wherein the system board is predominately made of double-sided copper clad laminate.

21. The method of claim 19, wherein utilizing a MIMO antenna includes utilizing a MIMO antenna wherein the system board measured a width 60 mm and a length L of 90 mm, thereby yielding permittivity and loss tangent values of the system board of 4.4 and 0.02, respectively.

22. The method of claim 19, wherein utilizing a MIMO antenna includes utilizing a MIMO antenna where the first lumped port and the second lumped port at the first side of the system board are provided opposite a second end of the system board that is proximate to the pair of antenna elements.

23. The method of claim 22, wherein utilizing a MIMO antenna includes utilizing a MIMO antenna wherein the ground plane longitudinally extends a length of about 70 mm from the first and second lumped ports along the bottom surface of the system board.

24. The method of claim 19, wherein utilizing a MIMO antenna includes utilizing a MIMO antenna wherein the least two microstrip lines measure 2.4×77 $mm^2$.

25. The method of claim 19, wherein utilizing a MIMO antenna includes utilizing a MIMO antenna wherein the ground plane has a width of 60 mm.

26. The method of claim 19, wherein utilizing a MIMO antenna includes utilizing a MIMO antenna wherein the center Z of the X Y coordinate system, and the center of the radiation sphere, are located proximate an origin of the expansion region.

27. The method of claim 19, wherein utilizing a MIMO antenna includes utilizing a MIMO antenna wherein the narrow end has a width of 4 mm and the wide end has a width of 8 mm.

28. The method of claim 19, wherein utilizing a MIMO antenna includes utilizing a MIMO antenna wherein sides of the Y-shaped slot extend in parallel from the narrow end a length equal to 10 mm before beginning to expand apart from one another to form the expansion region.

29. The method of claim 19, wherein utilizing a MIMO antenna includes utilizing a MIMO antenna wherein the Y-shaped slot has an overall length of 25 mm.

30. The method of claim 19, wherein utilizing a MIMO antenna includes utilizing a MIMO antenna wherein the miniature antenna elements of the at least pair of miniature antenna elements are spaced apart from one another approximately 30 mm.

31. The method of claim 19, wherein utilizing a MIMO antenna includes utilizing a MIMO antenna wherein the pair of miniature antenna elements includes half-cycle, microstrip meander structures having a hexaferrite substrate below each meander structure.

32. The method of claim 31, wherein utilizing a MIMO antenna includes utilizing a MIMO antenna wherein the hexaferrite substrate has dimensions substantially equal to 6×10×1.5 $mm^3$.

33. The method of claim 31, wherein utilizing a MIMO antenna includes utilizing a MIMO antenna wherein the hexaferrite substrate exhibits a relative permeability $\mu_r$ substantially equal to 1.66 (tan $\delta_\mu$=0.112) and a relative permittivity $\epsilon_r$ substantially equal to 6.5 (tan $\delta_\epsilon$=0.014).

34. The method of claim 31, wherein utilizing a MIMO antenna includes utilizing a MIMO antenna wherein copper (Cu) tape is attached to the hexaferrite substrate to provide the half-cycle, microstrip meander structure, as well as an electrical connection to the microstrip lines, and 1×1 $mm^2$ solder pads.

35. The method of claim 19, wherein utilizing a MIMO antenna includes utilizing a MIMO antenna that exhibits a radiation efficiency of at least 82% at 2.45 GHz.

36. The method of claim 19, wherein utilizing a MIMO antenna includes utilizing a MIMO antenna wherein the at least one pair of miniature antenna elements exhibit orthogonal 2D patterns, including a two lobe pattern set and an omnidirectional flower pattern set.

* * * * *